US005547261A

United States Patent [19]

Kölbl

[11] Patent Number: 5,547,261

[45] Date of Patent: Aug. 20, 1996

[54] MOVABLE RACK SYSTEM FOR LONGWALL CONVEYOR MEANS

[76] Inventor: Hans J. Kölbl, Starenweg 2, 47441 Moers, Germany

[21] Appl. No.: 377,043

[22] Filed: Jan. 23, 1995

[30] Foreign Application Priority Data

Dec. 1, 1994 [DE] Germany ..... 44 42 627.5

[51] Int. Cl.[6] ..... E21C 29/02

[52] U.S. Cl. ..... 299/43; 105/29.1

[58] Field of Search ..... 299/43, 42, 34; 105/29.1

[56] References Cited

U.S. PATENT DOCUMENTS 4,773,710 9/1988 Klimeck et al. ..... 299/43

FOREIGN PATENT DOCUMENTS 3703384 8/1988 Germany ..... 299/43

*Primary Examiner*—David J. Bagnell
*Attorney, Agent, or Firm*—James Creighton Wray

[57] ABSTRACT

In longwall conveyors 1 with a lantern pinion 10 arranged on the winning face side, an advantageous cooperation with the machine roadway 6 is made possible in that the lantern pinion 10 consists of several racks 21, 22, 23 which are arranged so that each of them bridges the conveyor trough faces 19, 20. These racks 21, 22, 23 consist of a plug-in element 28 with teeth 11, 24 and welded-in bolts 25, 26, which are held so as to be movable in longitudinal direction inside a preceding retaining plate 29. Retaining plate 29 and support plate 44, the latter of which is connected via fastening screw pairs 33, 34 with the vertical roadway flange 8, are associated with a guide slit 45 in which the racks 21, 22, 23 are able to move correspondingly in transport direction 46 according to the tooth pitch, so that a uniform engagement of the gearwheel 9 of the longwall machine 5 is always ensured. The partitioning the racks 21, 22, 23 and the retaining plates 29 and the attachment by way of fastening screw pairs 33, 34 largely permits a preassembly above-ground in an advantageous manner.

11 Claims, 2 Drawing Sheets

12
52
50
59
51
28
11
17
45
44
12
47
48
6,8
33
13
6,7
14

52
51
28
55
56
28
60
25,26
45
44
27
24,54
49
29

MOVABLE RACK SYSTEM FOR LONGWALL CONVEYOR MEANS

BACKGROUND OF THE INVENTION

The invention relates to a longwall conveyor with a lantern pinion arranged on the machine roadway side and consisting of consecutive racks which bridge the conveyor trough faces and are attached with a slight clearance, whose individual racks have a plate-shaped plug-in element with teeth welded into them and are fixed via bolts in a guide slit formed by a preceding retaining plate and a support plate associated with the vertical roadway flange.

Such longwall conveyors are equipped with lantern pinions in order to enable the roll charger or other longwall machine to move through the longwall, i.e. pull itself forward or backward along the racks which form the lantern pinions. Different types of lantern pinions or racks are known for this purpose, depending on whether they are supposed to be arranged on the winning face side or on the rock face side. Overall, it is the objective to make do with relatively little equipment and with favorable construction dimensions, whereby the racks are usually also shaped and constructed in such a way that the longwall machine guides itself along them. Such lantern pinions are usually arranged on the rock face side or the coal face side. Also known are however designs operating with two lantern pinions.

German DE-OS 29 14 861.6 describes a longwall conveyor with racks consisting both of plates with a height approximating that of the longwall conveyor height as well as of tooth-like noses projecting laterally from the plate. The machine roadway is shaped to the correspondingly shaped racks. The individual racks are fixed to the longwall conveyor or its conveyor troughs. The disadvantage is that in the case of tooth wear the entire rack must be replaced, requiring, due to the described connection, a significant expenditure of labor German DE-OS 37 03 384 0 describes racks screwed with the L-shaped machine roadway to the conveyor trough. The teeth and the bridge that is practically set onto the L-shaped machine roadway form a complete unit which can be manufactured and used as such in the form of forged parts. The machine roadway in its entirety is connected in the area of the conveyor trough connection via a toggle connection to the next machine roadway, resulting in a certain mobility. But in the case of rack wear or other repairs, the entire L-shaped machine roadway here also must be disassembled and reassembled subsequently. The expenditure is large. The described assembly and disassembly expenditure is also large for the longwall conveyor according to German DE-PS 37 00 489. Only smaller tooth groups have been provided for a better replacement; but even this does not reduce the assembly expenditure.

German DE-GM 93 11 553 in contrast describes a longwall conveyor in which optimum guidance of the roll charger is achieved while maintaining the tooth pitch, since the corresponding lantern pinion is composed of racks that are so long or so short that in each case a rack element bridges the conveyor trough faces. Since they are attached with a slight clearance, the tooth pitch is always ensured. Assembly and disassembly are facilitated in that the racks consist of a plug-in element and teeth welded into them, whereby these plug-in elements which form the racks are inserted into a slit from the top and are then fixed by way of bolts, whereby said slit is formed by a retaining plate and a support plate that are welded at a distance from each other to the horizontal flange of the machine roadway. The bolts are pushed into corresponding bores and are then fixed by way of cotter pins which can be hammered out towards the bottom through corresponding bores, even passing through the roadway, if the rack is supposed to be removed. The disadvantage here is the attachment of these bolts by way of cotter pins, since they require suitable bores and guide slits that reach far enough. Another disadvantage is that the vertical parts forming the guide slit must be welded to the roadway, thus requiring a certain amount of preliminary work aboveground and otherwise making assembly underground more difficult. But in particular, the individual parts must be brought underground in order to undergo final assembly into a complete conveyor trough or the respective partial lengths there.

SUMMARY OF THE INVENTION

The invention is therefore based on the task of creating a movable rack system that can be largely preassembled aboveground and can be finally assembled underground in a quick and safe manner while preserving optimum guidance of the longwall machine.

According to the invention this task is solved in that the retaining plates consist of parts with a length corresponding to the length of the racks and are arranged so as to be offset to the latter and connected to the support plate, and that the bolts are welded to the plug-in element and are constructed inside a bore that forms an ellipse in the transport direction so as to cooperate in the retaining plate, and that the support plate with the retaining plate is connected releasably to the vertical roadway flange via fastening screw pairs.

Such a design of the longwall conveyor makes it possible to use the individual conveyor troughs with or without the corresponding lantern pinion, since the lantern pinion is after all only completed by screwing the corresponding additional parts to it. On the other hand, it is, however, advantageously possible to preassemble the individual conveyor trough lengths largely aboveground, i.e. equip them already with the corresponding parts without requiring any welding. The individual parts of the lantern pinion are screwed on, whereby the retaining plates consist of parts enabling such a preassembly without any problems. The retaining plate or parts are fixed accordingly with screws, i.e. to the rack consisting of plug-in element and bolts which was already attached at the same time. The necessary mobility of the rack system is ensured since the bolts, which were fixed in the plug-in elements from the start, engage with ellipsoid bores in the retaining plate or cooperate with the latter, so that the plug-in element or the rack fixed behind it is able to move in the transport direction, in order to ensure an exact tooth engagement when the longwall machine drives over the lantern pinion. The paired arrangement of the fastening screws makes it possible to attach the preassembled retaining plate, which consists of individual parts, in a manner according to the given requirements, so that the assembly underground only requires a corresponding insertion and fastening of the fastening screws for completion.

According to one practical design of the invention, it is provided that the plug-in element has on both sides of the bolts a recess that reaches approximately to the top edge of the retaining plate. This design facilitates the paired arrangement of the fastening screws or fastening screw pairs even more and thus permits the respective preassembly aboveground. Accordingly, in another practical design, each part of the retaining plate has two fastening screw pairs associated with it, which are arranged spaced apart from each other so as to keep the respective conveyor trough faces exposed. This design makes it possible to position the respective end pieces of the retaining plates without any fastening screws, and thus also the ends of the support plate connected to it, so that the assembly is clearly facilitated. The conveyor troughs with their corresponding and described attachments are in a practical manner plugged inside each other and only require attaching or fastening of the fastening screw pairs for final assembly.

It is useful that the fastening screw pairs are protected from damage by providing bores accepting the nuts of the fastening screw pairs in the retaining plate. Since the retaining plate is fixed to the support plate by welding, it is then simultaneously fixed simultaneously with the tightening of the fastening screw pairs, whereby the nuts do not project beyond the retaining plate.

The same is achieved with a further development of the invention in respect to the bolts, since the guide head of the bolts that projects beyond the plug-in element is sized so as to correspond to the thickness of the retaining plate. In this way it does not project beyond its associated bore in the retaining plate, whereby this bore, as already mentioned, is constructed elliptical in order to ensure the mobility of the bolt and thus of the plug-in element.

In order to achieve a coverage regarding the retaining plate on the one hand and the support plate on the other hand, the invention provides that the parts of the retaining plate are arranged so as to be slightly offset to the center of the racks and thus also to the conveyor troughs. While the racks are arranged, as already mentioned, in such a way that each one of them bridges the conveyor trough faces, this is not the case for the retaining plate and the support plate. The latter are arranged in such a way that they each measure half the conveyor trough length and are arranged so as to be slightly offset from the center, so that one retaining plate or support plate projects on one side slightly beyond the next conveyor trough, while it does not quite reach the conveyor trough face on the other side of its own conveyor trough.

According to a practical design, the retaining plate has a special shape, since the top edge of the retaining plate is constructed in sine-shape, whereby the top arcs reach up to the teeth. This design results in a support of the teeth by the retaining plate without hindering the engagement of the gearwheel of the longwall machine. This is possible because part of the top edge engages immediately behind the arc, so that the gearwheel is able to, so to speak, dip into this part.

In order to provide better guidance of the longwall machine on the machine roadway, the invention also provides that, seen from the machine roadway, a guide bead is arranged on the rear of the plug-in element, in the part that projects beyond the vertical roadway flange. This guide bead makes it possible that the skid shoe can shape itself tightly to the machine roadway or the plug-in element, thus providing a uniform and safe guidance.

A better and more uniform running of a longwall machine through safe meshing of the gearwheel in the racks is also achieved according to the invention in that the teeth of the plug-in element, which are constructed as circular bolts, have on their free end a slope that slopes from the top edge to the machine roadway. The advantage here, based on the special design of the design in the form of circular bolts, is that the teeth of the gearwheel are able to roll off advantageously in a linear movement. The slope in particular prevents a soiling or a settling of dirt on the individual teeth.

It has already been explained above that the special design of the bolts and the bores in the retaining plate which guide them permits a longitudinal movement of each individual rack, whereby this is yet improved in that each plug-in element is chamfered at its end, whereby the chamfer is only present in the top half. If the individual racks abut each other, this therefore does not result in a wide-spread contact but rather only a point contact with the respectively next plug-in element, so that no damage can occur since the plug-in element presently in contact displaces the next one.

The invention is characterized in particular in that it creates a rack system that can be moved advantageously in a safe manner and can be largely preassembled aboveground. In the end, the individual conveyor trough faces can be pushed over each other and are then finally assembled by way of the usual retaining means and by tightening the fastening screw pairs. The expenditure is low. In the case of damage, only those fastening screw pairs for the replacement of specific partial lengths must be released, which again does not require much expenditure, since no welding is required at all. The individual racks which are supposed to bridge the conveyor trough faces also can be largely preassembled, since the support plate and the retaining plate are connected to each other so as to form the guide slit, whereby the individual racks have already been preassembled by delivering the individual plug-in elements underground with the bolts already arranged.

Other details and advantages of the subject of the invention can be deduced from the subsequent description of the corresponding drawing which shows a preferred embodiment with the necessary details and parts. The drawing shows in

DETAILED DESCRIPTION OF THE PREFERRED EMBODIMENTS

Figure 1:
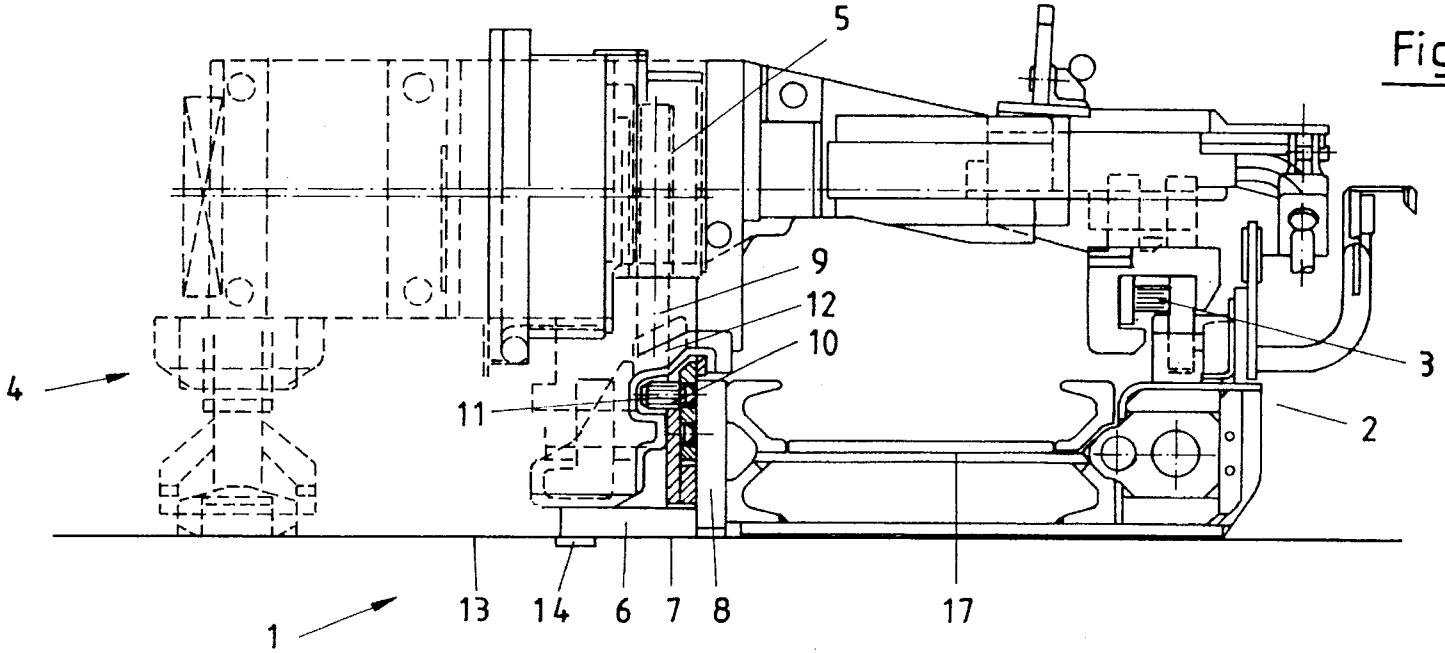
FIG. 1 a cross-section of a longwall conveyor with machine.

FIG. 1 shows a longwall conveyor 1 with a corresponding longwall machine 5. On the rock face side of the longwall conveyor the attachments 3 as well as a lantern pinion arranged there can be seen.

On the machine roadway side 4, the L-shaped machine roadway 6 can be seen, which supports the longwall machine 5. The machine roadway 6 consists of the horizontal flange 7 and the vertical flange 8 to which the lantern pinion 10 is mounted. Details will be explained below.

The lantern pinion 10 has circular bolt-shaped teeth 11 which mesh with a gearwheel 9 of the longwall machine 5. The skid shoe 12, with a shape commonly used for such longwall machines 5, is supported on the lantern pinion 10, whereby additional details will be explained below. The entire machine roadway 6 hereby supports itself on the footwall 13, whereby a certain degree of height adjustment can be achieved via a longitudinal bead 14, if needed.

Figure 2:
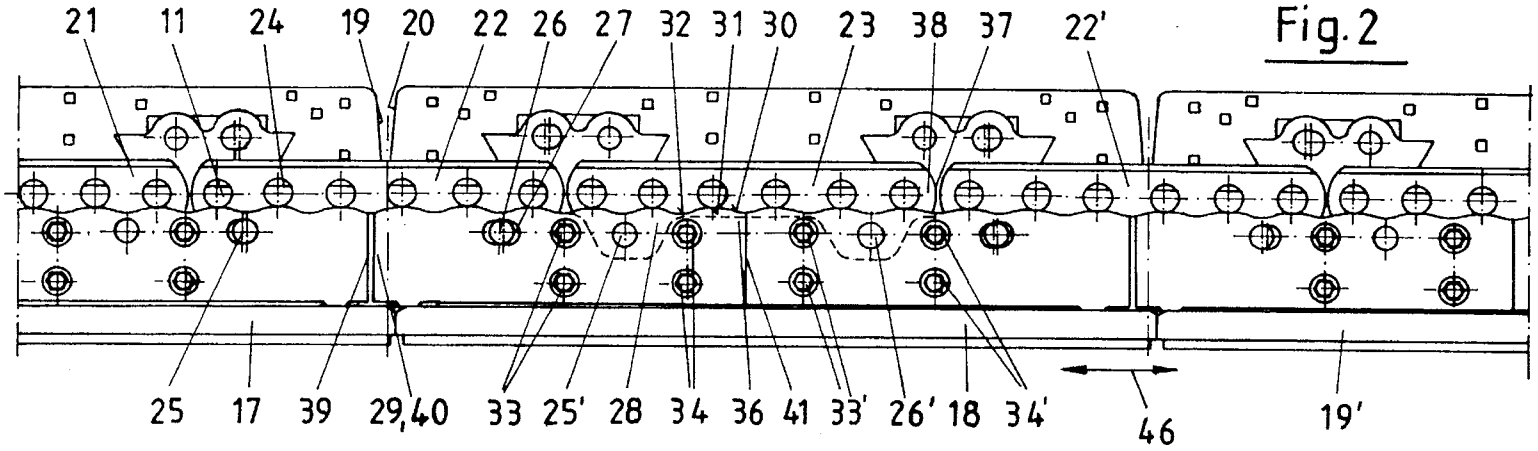
FIG. 2 the lateral view of the longwall conveyor with a lantern pinion arranged on the winning face side.

FIG. 2 shows a lateral view of the longwall conveyor 1 seen from the coal face. Clearly visible are three interconnected conveyor troughs 17, 18, 18'. In the area of the conveyor trough faces 19, 20, the conveyor troughs 17, 18 are bridged by a rack 22, whereby two each of these racks 21, 22, 23 have the length of a conveyor trough 17 or 18. This bridging arrangement of the racks 21, 22, 23 or, in this case, of the rack 22, 22', always ensures a uniform tooth pitch, whereby in addition a certain mobility in the transport direction 46 is provided. This also will be explained in more detail below.

The teeth 11, 24, which have a circular bolt shape in this case, each are arranged in a six-fold arrangement to one of the racks 21, 22, 23. To achieve a longitudinally mobile connection of the racks 21, 22, 23, these individual racks are guided via bolts 25, 26 in bores 27 of the preceding retaining plate 29. This bore 27 has an ellipsoid shape or the form of a longhole, so that the individual rack 22 is visibly able to move in transport direction 46. The individual racks 21, 22, 23 consist of the plug-in element 28 and the bolts 25, 26 welded to it, as is seen in particular in FIG. 4.

The top edge 30 of the retaining plate 29 has a special shape, in as far as it is sine-shaped. Hereby the arcs 31 of the top edge 30 reach up to the teeth 11, 24, thus resulting in a support, while the spaces between them form a type of valley 32, so that the teeth of the drive gearwheel (not shown) of the longwall machine 5 are able to engage easily.

FIG. 2 also shows that the retaining plate 29 consists of parts 40, 41. These parts 40, 41 of the retaining plate 29 each have a length corresponding to 50% of the conveyor trough 17, 18. These parts 39, 40, 41 of the retaining plate 29 each are hereby slightly offset from the center in order to achieve an overlapping with conveyor troughs 17, 18.

In addition, the retaining plate 29 or its parts 39, 40, 41 each are fixed at their ends by way of fastening screw pairs 33, 34 in such a way that they do not need any such fastening screws in the area of conveyor trough faces 19, 20. These relatively tightly spaced fastening screws 33, 34 can be installed in this manner because the plug-in element 28 has an opening 36 in the center. This is shown in the center of FIG. 2.

FIG. 2 also shows that the individual racks 21, 22, 23 or plug-in elements 28 have on their end face, in the top half 38, a chamfer 37, in order to permit a certain rolling off of the individual racks 21, 22, 23 from each other.

Figure 3:
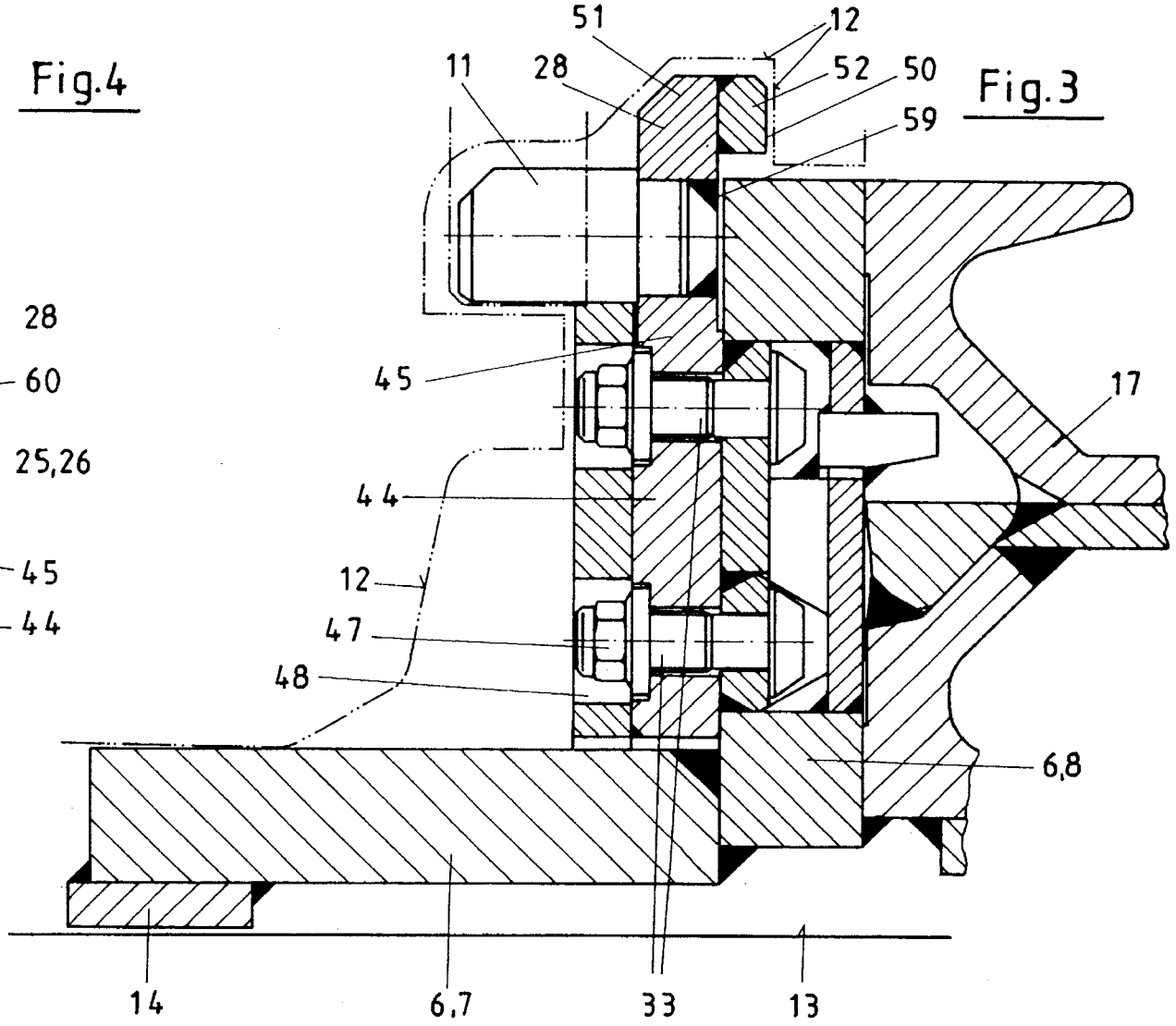
FIG. 3 a section through the winning face side of a longwall conveyor with machine roadway and lantern pinion.

The retaining plate 29 shown in detail in FIG. 2 and mentioned in the explanation is connected with the support plate 44 behind it by way of welding joints. This is shown in FIG. 3. This makes it possible to transport the individual conveyor troughs 17, 18, after having largely been preassembled aboveground, underground and to connect them there with each other in transport direction 46. The retaining plate 29 and the support plate 44 are connected by way of the mentioned fastening screw pairs 33, 34 to the vertical roadway flange of the machine roadway 6 behind them. This is clearly visible in FIG. 3, whereby the nuts 47 of the fastening screw pairs 33, 34 are protected inside a bore 48 in such a way that they do not project beyond the retaining plate 29.

Figure 4:
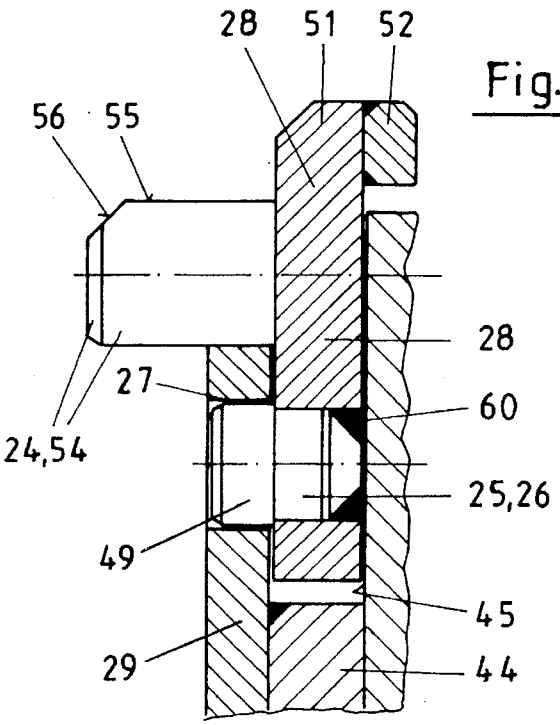
FIG. 4 a detail for clarifying the arrangement of the bolts welded to the plug-in element.

The same is principally true for the guide head 49 of the bolts 25, 26, as shown in FIG. 4. The guide head 49 corresponds in its dimensions to the thickness of the retaining plate 29, so that it does not project beyond the bore 27 or front of the retaining plate 29. The corresponding plug-in element 28 with the teeth 11, 24 is inserted, as already mentioned, in the guide slit between support plate 44 and retaining plate 29. This ensures an effective fixation of the individual racks 21, 22, 23, whereby on the rear side 50 of the top part 51 of this plug-in element 28 is attached a guide bead which ensures, as indicated in FIG. 3, a safe guidance of the skid shoe 12 in this area.

The free end 54 of the teeth 11, 24 has a slope 56 that extends from the top edge 55 in the direction of the machine roadway 6, as indicated in FIG. 4. The individual teeth 11, 24 are hereby circular bolts which according to FIG. 3 are welded into the retaining plate 29. The welding seam 59 shown in FIG. 3 hereby ensures an effective fixation, whereby no fixation or attachment to the vertical roadway flange 8 is provided.

Similarly, the bolt 25 or 26 is fixed in the plug-in element 28 by way of a welding seam 60.

All mentioned features, even those found only in the drawings, are regarded as essential to the invention either by themselves or in combination.

I claim:

1. A longwall conveyor having a lantern pinion on a machine roadway side comprising plural racks, plural conveyor trough faces, adjacent racks bridging the conveyor trough faces and being spaced apart, a plate-shaped plug-in element provided on each of the plural racks, each element having teeth welded thereon, vertical roadway flanges provided between the racks, each flange having a guide slit formed by a preceding retaining plate and a support plate, plural bolts for attaching the elements to the guide slits, each retaining plate comprising portions having lengths corresponding to lengths of the racks, the portions being arranged to be offset from the racks and the portions being connected to the support plate, and wherein the bolts are welded to the elements and, a bore is provided on each element wherein the bolts are connected to the retaining plates and fit within the bores to form an ellipse in a direction of transport, and fasteners for releasably connecting the support plates and the retaining plates to the vertical roadway flange.

2. The conveyor of claim 1, further comprising the elements having recesses on opposite sides of the bolts, each recess having a length at least equal to a top edge of each retaining plate.

3. The conveyor of claim 1, wherein each portion of the retaining plate has at least two spaced apart fasteners for exposing respective conveyor trough faces.

4. The conveyor of claim 3, wherein the fasteners are screws and nuts.

5. The conveyor of claim 4, further comprising bores provided on the retaining plates for receiving the nuts of the fastening screw pairs.

6. The conveyor of claim 1, wherein each bolt has a guide head, and a thickness of the guide head projecting beyond each element is similar to a thickness of the retaining plate.

7. The conveyor of claim 1, wherein the portions of the retaining plate are positioned spaced from central axes of the racks and the conveyor troughs.

8. The conveyor of claim 1, wherein a top edge of the retaining plate is formed as a sine-shape with an arc and wherein the top edge, whereby the arc extends to the teeth of each element.

9. The conveyor of claim 1, further comprising a guide bead on a rear side of each plug-in element.

10. The conveyor of claim 1, wherein the teeth of each element are circular bolts having free ends, the free end being sloped.

11. The conveyor of claim 1, wherein each plug-in element has a chamfered end on a top half of the element.

* * * * *